US011555617B2

(12) United States Patent
Blad et al.

(10) Patent No.: US 11,555,617 B2
(45) Date of Patent: Jan. 17, 2023

(54) HYDRAULIC UNIT FOR A HEATING OR AIR-CONDITIONING SYSTEM

(71) Applicant: GRUNDFOS HOLDING A/S, Bjerringbro (DK)

(72) Inventors: Thomas Blad, Bjerringbro (DK); Peter Mønster, Randers (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 678 days.

(21) Appl. No.: 16/483,999

(22) PCT Filed: Jan. 31, 2018

(86) PCT No.: PCT/EP2018/052425
§ 371 (c)(1),
(2) Date: Aug. 6, 2019

(87) PCT Pub. No.: WO2018/145975
PCT Pub. Date: Aug. 16, 2018

(65) Prior Publication Data

US 2020/0018491 A1 Jan. 16, 2020

(30) Foreign Application Priority Data

Feb. 8, 2017 (EP) ..... 17155234

(51) Int. Cl.
*F24D 19/10* (2006.01)
*F24D 3/02* (2006.01)
*F24H 9/14* (2006.01)

(52) U.S. Cl.
CPC ..... *F24D 19/1066* (2013.01); *F24D 3/02* (2013.01); *F24D 19/1033* (2013.01); *F24H 9/144* (2013.01); *F24D 2220/0235* (2013.01)

(58) Field of Classification Search
CPC ..... F24D 2220/0235; F24D 3/105
See application file for complete search history.

(56) References Cited

U.S. PATENT DOCUMENTS 4,708,287 A * 11/1987 De Wit ..... G05D 23/1932 237/8 R
5,209,401 A * 5/1993 Fiedrich ..... G05D 23/1393 237/80

(Continued)

FOREIGN PATENT DOCUMENTS

CN 2744980 Y 12/2005
CN 101344274 A 1/2009

(Continued)

OTHER PUBLICATIONS

Machine translation of DE102012024583A1, https://patents.google.com/patent/US20150122902A1/en?, retrieved Feb. 26, 2022 (Year: 2022).*

*Primary Examiner* — Avinash A Savani
*Assistant Examiner* — Deepak A Deean
(74) *Attorney, Agent, or Firm* — McGlew & Tuttle, P.C.

(57) ABSTRACT

A hydraulic construction unit for a heating facility or air-conditioning facility, includes a return connection (20) and a first feed connection (16) for a heating circuit (6), with a heat source outlet (12) fluid conducting connected to the return connection. A heat source inlet (14) is fluid conducting connected to the first feed connection and to a circulation pump assembly (28) in a flow path between the return connection and the heat source outlet (12) or in a flow path between the heat source inlet and the first feed connection. A second feed connection (18) for a second heating circuit (8), is fluid conducting connected to the heat source inlet and to the return connection. A mixing valve (54) is arranged in a flow path from the heat source inlet to the second feed connection and/or in a flow path from the return connection to the second feed connection.

20 Claims, 7 Drawing Sheets

(56) References Cited

U.S. PATENT DOCUMENTS

| | | | | |
|---|---|---|---|---|
| 5,617,994 | A * | 4/1997 | Fiedrich | F24D 10/006 237/63 |
| 2012/0018129 | A1* | 1/2012 | Ushijima | F24D 3/1066 137/340 |
| 2012/0312043 | A1* | 12/2012 | Kim | F25B 5/02 62/238.7 |
| 2015/0122902 | A1* | 5/2015 | Sorensen | F24D 3/125 137/563 |

FOREIGN PATENT DOCUMENTS

| | | | |
|---|---|---|---|
| CN | 201964500 | U | 9/2011 |
| CN | 105318039 | A | 2/2016 |
| DE | 3902378 | A1 | 8/1990 |
| DE | 102008013124 | A1 | 9/2009 |
| DE | 102012024583 | A1 | 6/2014 |
| DE | 102012024586 | A1 | 6/2014 |
| EP | 2148149 | A2 | 1/2010 |
| EP | 2397777 | A1 | 12/2011 |
| EP | 2942583 | A1 | 11/2015 |

* cited by examiner

HYDRAULIC UNIT FOR A HEATING OR AIR-CONDITIONING SYSTEM

CROSS REFERENCE TO RELATED APPLICATIONS

This application is a United States National Phase Application of International Application PCT/EP2018/052425 filed Jan. 31, 2018, and claims the benefit of priority under 35 U.S.C. § 119 of European Application 17 155 234.2, filed Feb. 8, 2017, the entire contents of which are incorporated herein by reference.

TECHNICAL FIELD

The invention relates to a hydraulic construction unit for a heating facility or an air-conditioning facility, with at least one pump assembly.

TECHNICAL BACKGROUND

Such a construction unit or housing unit for a heating facility is known for example from EP 2 397 777 A1. This construction unit comprises a circulation pump for delivering the heating medium, as well as in particular a heat exchanger for heating service (domestic) water. A switch-over valve is also provided, in order to switch the circuit for the heating medium between the mentioned heat exchanger and a connected heating circuit. The pump assembly can thus deliver the heating medium, in particular water, either through the heat exchanger for heating service water or through a connected heating circuit of a building, depending on the position of the switch-over valve. The construction unit moreover comprises connections for connection to a heat source, in particular to a primary heat exchanger of a boiler, via which the heating medium is heated in the circuit.

The disadvantage of these known construction units for heating facilities is the fact that a temperature regulation for the temperature of the heating medium is extremely difficult. As a rule, this is only possible by way of adapting the output of the heat source. Moreover, it is always the same heading medium temperature which is provided for all existing heating circuits.

SUMMARY

With regard to this problem, it is the object of the present invention, to provide a hydraulic construction unit for a heating facility or air-conditioning facility, which permits an improved temperature setting/adjustment of the heating and cooling medium respectively, said heating and cooling medium being delivered through the heating facility and air-conditioning facility respectively.

This object is achieved by a hydraulic construction unit for a heating or air-conditioning facility, with the features according to the invention. Preferred embodiments are to be deduced from this disclosure including the attached figures.

The hydraulic construction unit according to the invention is envisaged for use in a heating facility or air-conditioning facility, wherein with the use in a heating facility, a heated fluid heat transfer medium, in particular water, is delivered as a heating medium though the hydraulic construction unit, whereas with the use in an air-conditioning facility, it is a cooled fluid heat transfer medium which is used. When hereinafter, it is merely the application in a heating facility which is described, then despite this, it is to be understood that the invention can also be applied in a corresponding manner to an air-conditioning facility and the application in an air-conditioning facility is to expressly include the respective features. The term heating medium is thereby expressly also to include a cooling medium. Moreover, the term heat source, in the claims as well as the subsequent description is to expressly include a cold source on use in an air-conditioning facility.

The hydraulic construction unit comprises at least one circulation pump assembly which serves for delivering a fluid heat transfer medium serving as a cooling or heating medium, through the heating or air-conditioning facility. The heating medium is preferably water in the case of a heating facility. With regard to the circulation pump assembly, it can particularly be the case of a wet-running centrifugal pump assembly, which is to say a centrifugal pump assembly with a canned motor.

The hydraulic construction unit according to the invention, as with known hydraulic construction units, moreover comprises at least one return connection for a heating circuit and a first feed connection for a heating circuit. A heating circuit through a building for heating the building can be connected to these connections in the usual manner. This can be a cooling circuit for cooling a building, in the case of an air-conditioning facility. The thermally treated heating medium is led into the building via the feed connection (forward connection), and it flows through the return connection, back into the hydraulic construction unit. Here, thermally treated is to be understood as increasing or decreasing the temperature in accordance with the requirements. The hydraulic construction unit according to the invention moreover comprises a heat source outlet and a heat source inlet, to which a heat source, for example a heating boiler, in particular a gas heating boiler can be connected. The heat transfer medium is thermally treated via the heat source, i.e. is heated in the case of a heating and is cooled in the case of an air-conditioning facility. The heat source outlet in the hydraulic construction unit is connected to the return connection in a fluid-conducting manner. The fluid entering into the return connection is led further to the heat source outlet and from this into the heat source, so as to be thermally treated, which is to say heated up, anew. The first feed connection, in the hydraulic construction unit is connected to the heat source inlet in a fluid-conducting manner, so that the fluid which is thermally treated in the heat source can be fed via the heat source inlet through the hydraulic construction unit to the first feed connection. The circulation pump assembly is either situated in the flow path between the return connection and the heat source outlet or however in a flow path between the heat source inlet and the first feed connection. The circulation pump assembly is thereby arranged such that it delivers the heat transfer medium which is to say the fluid acting as a heat transfer medium, through the complete circuit, i.e. through a heating circuit arranged at the feed connection and return connection, as well as through the heat source which is connected to the heat source outlet and the heat source inlet.

According to the invention, the hydraulic construction unit comprises a second forward connection, which serves for being able to supply at least one second heating circuit with a heat transfer medium having a different temperature than the heat transfer medium which is fed to the first feed connection. Thus at least two feed connections which are able to provide different feed temperatures are present on the construction unit. This makes sensor for example in the case of heating facilities which comprise a floor heating as well as conventional radiators, due to the fact that the normal radiators can been be supplied with a higher feed temperature e.g. via the first feed connection, whereas the circuits of the floor heating can be supplied with a lower feed temperature via the second feed connection. In the hydraulic construction unit, the second feed connection is connected in a fluid-leading manner to the heat source inlet and additionally to the return connection, so that a mixture of fluid from the heat source inlet and the return connection can be fed to the second feed connection, in order to be able to adjust the temperature of the heat transfer medium which is to say the feed temperature at the second feed connection differently to the temperature at the first feed connection. A mixing valve is arranged in the flow path from the heat source inlet to the second feed connection and/or in the flow path from the return connection to the second feed connection. The mixing ratio between the fluid flows can be adjusted by the mixing valve, so that the temperature at the second feed connection can be changed. In the case of a heating system, colder fluid from the return connection is admixed to the fluid from the heat source inlet. In the case of a cooling system or an air-conditioning facility, warmer fluid from the return connection can be admixed to the cold fluid from the heat source inlet. The mixing valve is configured to set or adjust the flow in the respective flow path. The mixing valve can preferably be configured such that it can completely close the respective flow path, so that no admixing of warm or cold fluid whatsoever is effected.

The circulation pump assembly is preferably connected to the return connection via a suction-side flow path, through which the heat transfer medium is sucked by the centrifugal pump assembly. The hydraulic construction unit moreover comprises at least a section of a first delivery-side flow path and preferably at least a section of a second delivery-side flow path. This means that the hydraulic construction unit is configured such that it is applied in a heating or air-conditioning facility, in which at least two delivery-side flow paths, through which the heat transfer medium delivered by the circulation pump assembly flows, connect to the circulation pump assembly. A delivery-side arrangement of the flow paths thereby means that a pressure which is greater than at the suction side of the circulation pump assembly, which is to say than in the suction-side flow path, prevails in these flow paths or the mentioned sections. In particular, this means that the pressure drop in the delivery-side flow paths corresponds to less than half of the pressure difference between the suction side and the delivery side of the circulation pump assembly. Particularly preferably, the delivery-side flow paths lie upstream of the consumers in the heating or air-conditioning facility, at which consumers the heating power or cooing power is essentially taken and in which the greatest pressure drops occur.

According to the invention, one envisages the first and the second flow path running out into a common flow path, wherein the common flow path and the mixing point, at which the first and the second flow path run out into the common flow path, are likewise arranged in the hydraulic construction unit. The common flow path leads to the second feed connection. The mixing valve is arranged in at least one of the mentioned sections of the two delivery-side flow paths. The mixing valve serves of varying the flow cross section in the respective flow path, in order to change the flow through the associated flow path. Thus a cross-sectional ratio between the first and the second delivery-side flow path can be changed via the mixing valve, by which means the mixing ratio, with which the flows are mixed at the mixing point which is to say in the run-out into the common flow path, are changed.

Whereas the common flow path runs out into the second feed connection, one of the two flow paths yet leads to the first feed connection, additionally to the run-out into the common flow path. It is possible to feed heat transfer media of a different temperature to two heating circuits in this manner. One heating circuit directly receives the heat transfer medium with the temperature from one of the two flow paths, whilst the other heating circuit via the second feed connection receives the heat transfer medium with the temperature after the mixing of the flows from both flow paths. The second heating circuit can thus be a floor heating for example, which is operated at a lower feed temperature, whilst the first heating circuit is a heating circuit with normal radiators which is supplied with a higher feed temperature. Preferably, the described first feed connection for a first heating circuit is connected to that one of the two delivery-side flow paths which leads the heat transfer medium which was previously thermally treated in a heat source or cold source, i.e. is fed via the heat source inlet. The other, delivery-side flow path preferably leads fluid which is fed from a return of the heating or cooling circuit, i.e. the return connection.

At least sections of the first and second flow path are formed in the hydraulic construction unit according to the invention, in particular those sections, in which the mixing valve is arranged. This means that the first and the second delivery-side flow paths are not completely formed in the hydraulic construction unit, but in contrast additionally run through further components connecting to the hydraulic construction unit. Thus one of the delivery-side flow paths runs via the heat source outlet, a heat source connected to this and back into the heat source inlet. As the case may be, the heat source, for example a heat exchanger, can be co-integrated into the hydraulic construction unit.

According to a first possible embodiment of the invention, the mixing valve can be arranged in only one of the first and the second delivery-side flow paths, for changing the cross section of this delivery-side flow path. This means that the cross section of the other flow path is constant. The admixing of fluid from the flow path with the mixing valve can be varied by way the adjustment of this valve.

Alternatively, it is possible to arrange the mixing valve in the first and the second delivery-side flow path, in a manner such that the cross sections of the first and second delivery flow path are changeable via the mixing valve, in particular in a simultaneous manner. This means that with this arrangement, there is a valve element which intervenes in sections of the first as well as of the second flow path, or there are two valve elements which are coupled to one another, of which a first valve element is situated in a section of the first flow path and a second valve element in a section of the second flow path. The coupling of the movement of the valve elements can be effected mechanically or also in an electronic manner, via a suitable activation of the drives of the valve elements. Preferably, the mixing valve is configured such that when the cross section of the second flow path is enlarged, the cross section of the second flow path is simultaneously reduced in size to the same extent. Further preferably, the mixing valve can be configured such that at least one of the flow paths can also be completely closed.

Particularly preferably, the mixing valve can be configured as a three-way mixing valve. Such a mixing valve preferably simultaneously comprises the mixing point, at which the first flow path and the second flow path run out into a common flow path. The three-way mixing valve thus preferably comprises two inlets, of which a first inlet is connected to the first delivery-side flow path and a second inlet to the second deliver-side flow path. The third connection of the three-way mixing valve forms an outlet which is connected to the common flow path or defines this. The three-way mixing valve comprises a valve element, by way of whose movement the cross sections of the two inlets can be changed and therefore the cross-sectional ratio between the first and the second flow path can be changed.

According to a further preferred embodiment of the hydraulic construction unit, the mixing valve comprises two inlets as well as one outlet, as has been described above, wherein a first inlet of the mixing valve is thereby connected to the heat source inlet. A second inlet of the mixing valve is connected to the delivery side of the circulation pump assembly, upstream of the heat source outlet. This means that a flow which had previous flowed through a heat source connected to the heat source outlet and the heat source inlet and has been thermally treated there is delivered to the first inlet of the mixing valve by the circulation pump assembly. The second inlet of the mixing valve is connected directly to the delivery side of the circulation pump assembly, upstream of the heat source outlet, so that a flow which has not flowed through the heat source and thus has a temperature which corresponds to the inlet-side temperature of the circulation pump assembly flows to this second inlet of the mixing valve. As described above, the suction side of the circulation pump assembly is connected to the return connection, at which the heat transfer medium usually has the lowest temperature in the case of a heating circuit. This means that with this embodiment, the first delivery-side flow path is led through the heat source, whilst the second delivery-side flow path is led parallel to the heat source, past this to the mixing valve. Both flows are mixed in the mixing valve, wherein the cross-sectional ratio of the flow paths can be changed by way of adjusting the mixing valve, such that the mixing of the two flows and thus the temperature of the arising mixture can be changed due to the different temperatures in the two flow paths.

The outlet of the mixing valve is preferably connected to the second feed connection provided for connection of second heating circuit or cooling circuit. With the application in a heating facility, a floor heating for example, which as a rule is operated with a lower feed temperature than is provided by the heat source such as e.g. a primary heat exchanger, can be connected to this feed connection.

According to a further preferred embodiment of the invention, the mixing valve can be integrated into a pump housing (casing) of the circulation pump assembly. Thus in particular at least a section of a housing of the mixing valve can be configured as one piece at least with a section of the pump housing, in particular as an injection molded part of plastic. This permits a very compact construction and in particular an inexpensive manufacture and simple assembly.

In the hydraulic construction unit according to the invention, the mixing valve preferably comprises a movable valve element as well as an electric drive motor which moves this valve element and which is preferably configured as a stepper motor. The valve element can be moved via the electric drive motor into different switching positions, in which it adjusts the cross-sectional ratio between the first and the second flow path to a different extent. The valve element can be moved into defined positions via a stepper motor as a drive motor, without requiring additional sensors for determining the position of the valve element. The valve element can be configured in a pivotably, rotatingly or also linearly movable manner, wherein a suitable coupling to the drive motor is provided in each case. The drive motor can likewise be configured as a rotating or linearly acting drive motor.

According to a particular embodiment of the invention, the movable valve element of the mixing element is preferably arranged in the inside of a valve housing, whereas the drive motor is arranged outside this valve housing, wherein the valve element is pivotable about a pivot axis and is connected to the drive motor via an actuating lever extending transversely to the pivot axis. Thereby, the actuating lever extends through an elastic seal, out of the valve housing. This arrangement has the advantage that one can make do without dynamic seal in the valve housing, for the connection between the valve element and the drive motor. The pivoting movement can be achieved by an elastic seal, such as a sealing sleeve. A very simple and reliable sealing is achieved by way of this. The actuating lever can be moved outside the valve housing, for example by way of a linearly acting drive motor, in order to pivot the valve element in the inside of the housing. A linearly movable valve element would also be movable in the inside of the valve housing via such an actuating lever. The pivoting movement however has the advantage that the valve element can be fixedly coupled to the activation lever without further guide elements, in particular can be configured as one piece with this. The valve element and the actuating lever can thus be manufactured very simply as a single-piece component and as a plastic injection molded part. The valve element preferably comprises two valve surfaces which are away from one another and which can be approached to oppositely lying valve seats or be moved away from these, in order to change the flow cross sections. The valve surface can come to bear on the valve seat for a complete sealing off. The two valve seats thereby preferably lie opposite one another and the valve element with two valve surfaces which are away from one another is arranged between the valve seats lying opposite one another.

According to a further preferred embodiment of the invention, the hydraulic construction unit comprises a secondary heat exchanger for thermally treating, in particular heating service water, as well as a switch-over valve which is arranged in a manner such that a flow path connected to the circulation pump assembly, by way of the switch-over valve can be switched between the secondary heat exchanger and at least one heating circuit connection formed on the construction unit. Thereby, the flow path through the secondary heat exchanger preferably branches away from the delivery-side flow path, upstream of the described mixing valve and downstream of the heat source inlet, as has been described above, so that the heat transfer medium heated in the heat source can be led through the secondary heat exchanger, in order there to heat service water which flows through a second side of the secondary heat exchanger. The switch-over valve permits the flow path through the secondary heat exchanger to be disconnected, and instead of this, the heated heat transfer medium to be led through the feed connections formed on the construction unit. The heating medium which is to say the heat transfer medium can be led through the connected heating circuits, in order to heat a building. If service water is to be heated, the switch-over valve switches over the flow path, so that the heating circuits are disconnected and, instead of this, the heat transfer medium is led through the secondary heat exchanger, for heating the service water. Apart from the described arrangement at the inlet side of the secondary heat exchanger, the switch-over valve can alternatively also be arranged at the outlet side of the secondary heat exchanger, i.e. in particular at a return to the suction side of the circulation pump assembly. The switch-over valve at this location can switch between a flow path from the return connection to the circulation pump assembly, and a flow path from the secondary heat exchanger to the circulation pump assembly. The flow is thus either delivered through the secondary heat exchanger or through the heating circuits which are connected to the feed conduits and subsequently to this through the return connection, depending on which of the flow parts is connected to the circulation pump assembly.

The switch-over valve preferably comprises a moving valve element and an electrical drive motor which moves this valve element and which is preferably configured as a stepper motor. The valve element is preferably movable to and fro between two valve seats, wherein this valve element too can be pivotably movable between two valve seats lying opposite one another. The drive motor is preferably arranged outside a valve housing of the switch-over valve and is connected to the valve element via an actuating lever. The actuating lever is preferably led out of the valve housing through an elastic seal in a wall of the valve housing.

According to a particularly preferred embodiment of the invention, the valve element of the mixing valve is configured in the same manner as the valve element of the switch-over valve and/or the drive motor of the mixing valve is configured in a the same manner as the drive motor of the switch-over valve. Configured in the same manner thereby means that the elements are configured in an essentially equal manner, for example have the same basic shape or the same basic configuration. Particularly preferably, the valve elements of the mixing valve and switch-over valve are configured identically and/or the drive motors of the mixing valve and of switch-over valve are configured identically. This permits a significant reduction in the variety of parts. The elastic feed-through of the valve element or of its actuating lever, through a wall of the valve housing, with regard to the mixing valve can be configured in the same manner or identically as with the switch-over valve. Further preferably, the configuration and the geometric arrangement of the valve seats, with regard to the switch-over valve can be configured in the same manner as the configuration of and geometric arrangement of the valve seats of the mixing valve, or identically to this configuration and arrangement. This means that according to the invention, essentially the same or identically configured valves can be applied for different purposes, specifically on the one hand as a mixing valve and on the other hand as a switch-over valve. The difference in function is preferably achieved merely by way of the activation of the drive motor. Whereas with a switch-over valve, the drive motor merely moves the valve element between two switching positions, in which one of the two valve seats is always closed, in the case of a mixing valve, the valve element is moved in steps or, as the case may be, also in a stepless manner, between several switching positions, in order to reciprocally vary the opening degree of the two valve seats, which is to say whilst the opening cross section at one valve seat is enlarged, preferably the opening cross section at the other valve seat is reduced in size, in order to vary the mixing ratio of the flows flowing out of the valve seats, to one another. Also with regard to the mixing valve, the valve element can be brought to bear on one of the valve seats, in order to completely close this flow path.

Further preferably, the drive motor of the mixing valve and the drive motor of the switch-over valve comprise a common motor driver, in particular a stepper motor driver which selectively activates the drive motor of the mixing valve or the drive motor of the switch-over valve. The number of necessary individual parts in the control electronics can be reduced by way of this. The mixing valve and the switch-over valve although then not being able to be actuated simultaneously, as a rule however, such a functionality is not necessary in practice. If the switch-over valve is switched such that the heating medium is led through the secondary heat exchanger for heating service water, then a temperature regulation in the heating circuit is not necessary, since this is disconnected in any case. If the switch-over valve is switched such that heating medium is led through the heating circuit or circuits, then the mixing valve can be moved by the motor driver and the respective drive motor, in order to adjust the temperature of the heating medium for at least one heating circuit. In this operating condition however, the switch-over valve no longer needs to be switched over. The drive motor of the mixing valve and the drive motor of the switch-over valve are preferably configured in a self-holding manner, so that they retain their position in the condition without flow.

The mixing valve preferably comprises a mixer control device which controls or regulates the setting/adjustment of the mixing valve, for achieving a desired fluid temperature at the exit side of the mixing valve, which is to say in the common flow path, and preferably at least partly is arranged with the pump control device of the circulation pump assembly in a common electronics housing. This electronics housing can further preferably be an electronics housing which is attached directly on the circulation pump assembly or integrated into the circulation pump assembly. The necessary motor driver for activating the drive motor of the mixing valve can be integrated into this mixer control device or however can also be arranged externally, so that the mixer control device sends a control command to the motor driver, said motor driver in turn then activating the drive motor. The mixer control device can moreover be integrated into a superordinate heating or cooling facility control, but can also be configured separately from this. It is conceivable for the motor driver for activating the drive motor of the mixing valve and of the drive motor of the switch-over valve to be integrated into such a heating control, whilst the mixer control device is integrated into the hydraulic construction unit and further preferably into a pump control device. The mixer control device then sends a control command for setting the mixing valve, to the heating control which via the motor driver which is present there initiates the drive motor of the mixing valve into moving to a desired position, If, conversely the mixer control device is integrated into a superordinate heating or air-conditioning control, then it would likewise be conceivable to integrate the necessary motor driver into the hydraulic construction unit and further preferably into the pump control device, so that the drive motors there are connected to the motor driver which in turn obtains its control commands from a superordinate control device, for example the heating control. A switch-over device which switches over the activation between two outputs, to which the two drive motors are connected, which is to say selectively addresses these outputs, is integrated into a common motor driver in the case of the use of a common motor driver.

According to a further preferred embodiment of the invention, the circulation pump assembly is arranged in a first subassembly of the hydraulic construction unit, whereas the mixing valve is arranged in a second subassembly of the hydraulic construction unit, wherein the first subassembly comprises the heat source outlet connected to the delivery side of the circulation pump assembly, and the second subassembly comprises the heat source inlet connected to the mixing valve, wherein the heat source outlet and heat source inlet are provided for the connection of a heat source connecting them, such as e.g. a primary heat exchanger of the heating or air-conditioning facility. Such a hydraulic construction unit can be installed in a heating facility, for example into a compact heating facility and there provides preferably essentially all internal flow paths, so that the hydraulic construction unit then only needs yet to be connected to the primary heat exchanger which is present in the heating facility and which serves as a heat source.

Further preferably, in the second subassembly, the heat source inlet is connected to a first feed connection provided for connection of a first heating circuit and to a first inlet of the mixing valve. Thus a heat transfer medium which is thermally treated in the heat source can be fed to the first feed connection as well as to the mixing valve. The heat transfer medium at the temperature after having been thermally treated by the heat source is therefore present at the first feed connection. The temperature can be suitably changed in the mixing valve by way of correspondingly admixing a heat transfer medium flow from the second, delivery-side flow path, in order to provide an accordingly differently thermally treated heat transfer medium at a second feed connection.

According to a further preferred embodiment of the invention, the construction unit comprises a secondary heat exchanger for thermally treating service water, and a first heat exchanger connection which is connected to the heat source inlet and which is connected to a heating water inlet of the secondary heat exchanger is arranged in the second subassembly. A heating medium which is to say heat transfer medium, which was previously heated which is to say thermally treated in the heat source is thus also led to the secondary heat exchanger at its heating water inlet.

A switch-over valve which comprises a first and a second inlet as well as an outlet and which is configured for switching a flow path between the two inlets is preferably arranged in the first subassembly, wherein the first inlet is connected to the heating water outlet of the secondary heat exchanger and the second inlet is connected to the return connection. The heating medium which is to say the heat transfer medium can thus be delivered by the circulation pump assembly, either through the secondary heat exchanger or through the heating circuits ending at the return connection, depending on the switching position of the switch-over valve. The switch-over valve is preferably configured in the manner described above.

The described two subassemblies of the hydraulic construction unit are preferably arranged at two ends of the secondary heat exchanger which are opposed to one another and are connected to one another via the secondary heat exchanger, a connected heat source and the second flow path for the connection of the delivery side of the circulation pump assembly to the second inlet of the mixing valve. The subassemblies are preferably configured of one or several parts of plastic and apart from the described flow paths for the heating medium preferably additionally comprise flow paths for the service water to be heated, said latter-mentioned flow paths connecting the secondary heat exchanger to corresponding service water connections on the hydraulic construction unit. A service water feed as well as a conduit for heated service water is connected to the service water connections.

However, in contrast to the previously described embodiments, it is also conceivable to arrange a switch-over valve and a mixing valve in a common subassembly.

The described hydraulic construction unit, as described above, can preferably be integrated into a heating facility, preferably into a compact heat facility. In an alternative embodiment however, it is also possible to apply the hydraulic construction unit according to the invention as an autarkic construction unit, so that it can be connected to a heating facility on location in a building by way of external pipe conduits. The construction unit preferably comprises fastening elements for this, wherein these are configured to fasten the construction unit on a wall. In particular, a supporting element comprising these fastening elements and serving as a supporting structure for the hydraulic construction unit according to the invention can be provided. This supporting element is preferably manufactured of metal, for example of sheet metal. The remaining parts of the hydraulic construction unit which define the described hydraulic connections, are preferably manufactured of plastic, in particular plastic injection molded parts. It is advantageous to fasten such an arrangement on a supporting element accommodating the holding forces, so that the plastic parts which define the hydraulic flow paths are relieved of such holding forces. The supporting element can be part of a housing which surrounds the complete hydraulic unit.

Further preferably, the return connection, the first and second feed connection, the heat source outlet, the heat source inlet and, inasmuch as present, preferably also a service water inlet as well as a service water outlet are provided with hydraulic connection elements for the connection of external pipe conduits. If, as described, the hydraulic elements of the construction unit are manufactured from plastic, then it is advantageous to form the hydraulic connection elements as metal inserts which serve for the connection of external pipe conduits. The hydraulic connection elements in particular comprise preferably outwardly directed connection threads, onto which external pipe conduits can be screwed.

Further preferably, the described hydraulic connection elements are connected to at least one mechanical supporting element, additionally to the connection to the flow paths in the inside of the construction unit. This supporting element is further preferably the supporting element which has been described above and which serves for fastening the hydraulic construction unit on a wall. Alternatively, the supporting element which is connected to the hydraulic connection elements can be mechanically connected to a further supporting element which carries the hydraulic construction unit and is configured for attachment on a wall. The connection of the hydraulic connection elements to one or more supporting elements has the advantage that mechanical forces which are exerted onto the hydraulic connection elements on connecting the external pipe conduits are transmitted onto the supporting element and thus kept remote from those elements which define the hydraulic flow paths. The mechanical supporting elements which hold the hydraulic connection elements are preferably configured as sheet components of metal.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
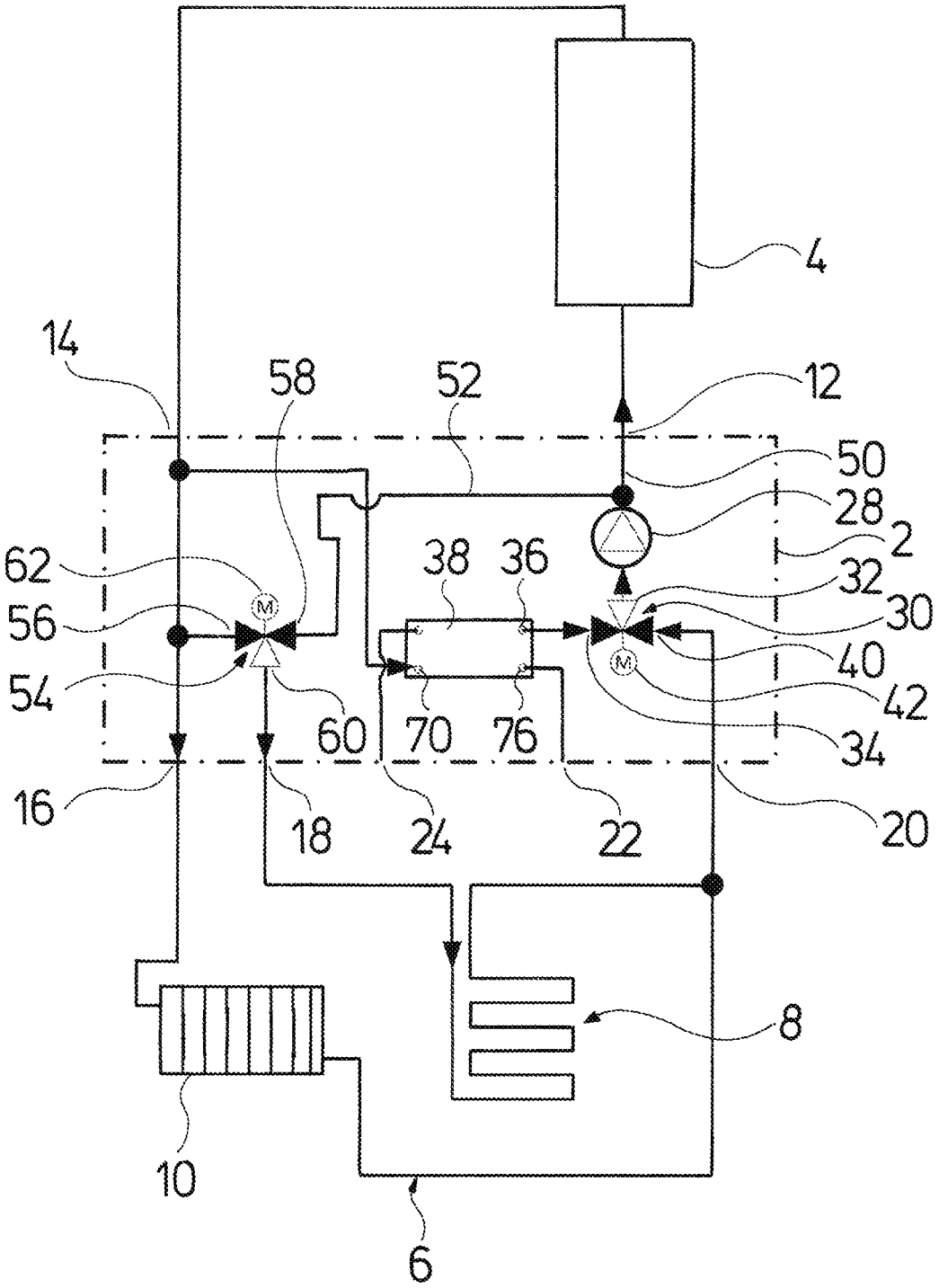
FIG. 1 is a circuit diagram of a heating facility with a hydraulic construction unit according to the invention.

Referring to the drawings, FIG. 1 shows a heating facility which comprises a hydraulic construction unit 2 according to the invention, a heat source in the form of a primary heat exchanger 4 as well as two heating circuits 6 and 8. The heating circuit 6 is thereby a heating circuit which runs through radiators 10 (only one is represented schematically in the figure), whereas the heating circuit 8 is a heating circuit which forms a floor heating. Thereby, it is to be understood that the heating circuit 8 in turn can be subdivided into several floor heating circuits. The primary heat exchanger 4 in particular is part of a gas heating boiler. The primary heat exchanger 4 and the hydraulic construction unit 2 as a whole can be integrated into a compact heating facility, in particular into a gas heating facility. The hydraulic construction unit 2 thereby integrates all essential hydraulic components which are necessary for the operation of the heating facility.

The hydraulic construction unit 2 comprises a heat source outlet 12 and a heat source inlet 14, onto which outlet and inlet the primary heat exchanger 4 can be connected via suitable pipe conduits. The heating medium or the heat transfer medium to be thermally treated (preferably water) exits out of the hydraulic construction unit 2 from the heat source outlet 12. The thermally treated heating medium enters again into the hydraulic construction unit 2 through the heat source inlet 14. For the connection of the heating circuits, the hydraulic construction unit 2 comprises a first feed connection 16, to which the first heating circuit 6 through the radiators 10 is connected, as well as a second feed connection 18, to which the second heating circuit 8 for the floor heating is connected. The hydraulic construction unit 2 moreover comprises a return connection 20, to which the common return of the two heating circuits 6 and 8 is connected.

The hydraulic construction unit 2 which is represented here moreover serves for heating service water, and for this comprises a service water inlet 22 as well as a service water outlet 24. Cold service water, which is to say service water to be heated, is fed through the service water inlet 22, and the thermally treated service water, which is to say heated service water 24 exits from the service water outlet 24. External pipe conduits are connected to these five connections 16, 18, 20, 22 and 24. For this, the connections are preferably provided with suitable connection elements or fittings 26 which in this embodiment example are configured as threaded connections.

Figure 6:
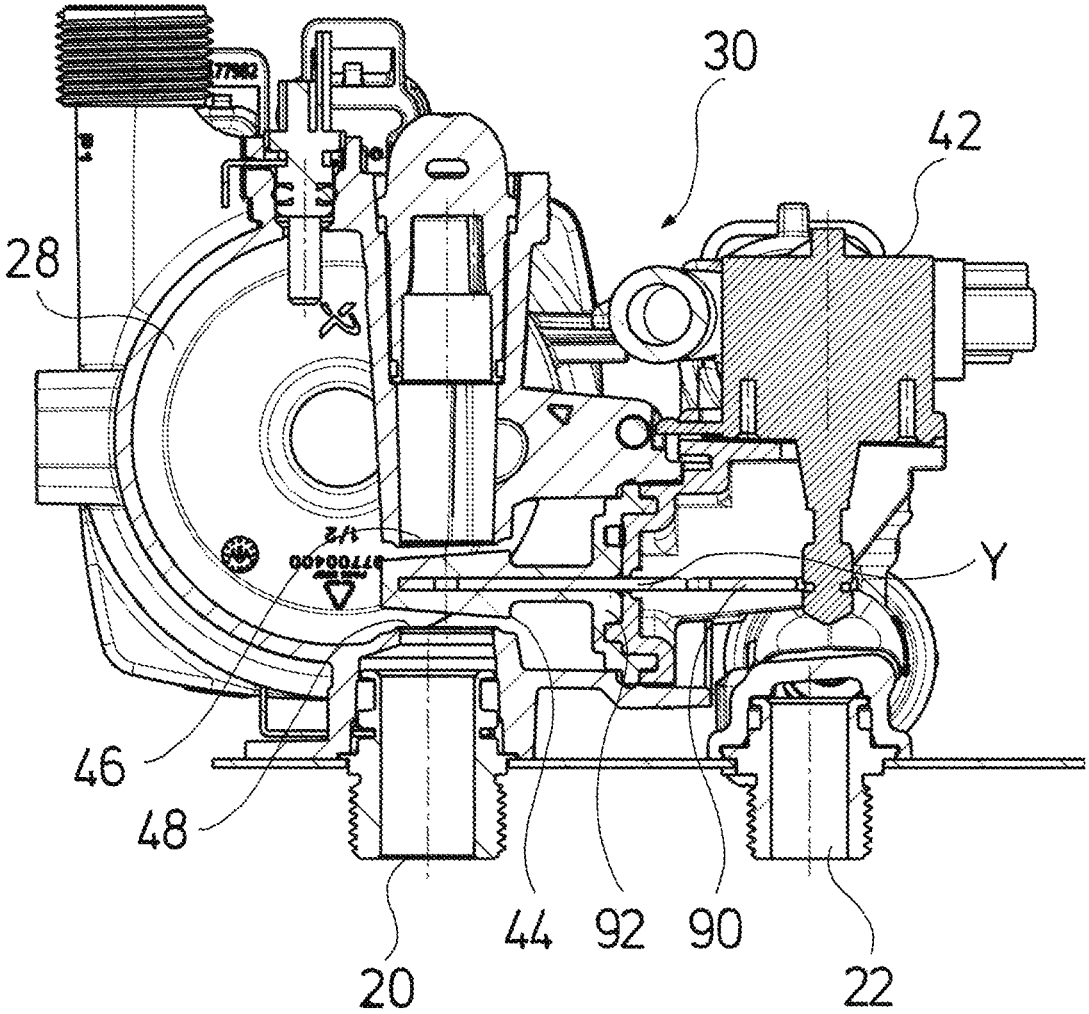
FIG. 6 is a sectioned view of the switch-over valve of the hydraulic construction unit.

In its inside, the hydraulic construction unit 2 comprises a circulation pump assembly 28, at whose inlet side which is to say suction side a switch-over valve 30 configured as a 3/2-way valve is situated. The switch-over valve 30 is connected with is outlet 32 to the suction side of the circulation pump assembly 38. A first inlet 34 of the switch-over valve 30 is connected to the heating water outlet 36 in the first hydraulic side of a secondary heat exchanger 38 serving for heating service water. The second inlet 40 of the switch-over valve 30 is connected to the return connection 20 by a flow path formed in the inside of the hydraulic construction unit 2. The switch-over valve 30 comprises a drive motor 42 which is configured as a stepper motor. The drive motor 42 moves a valve element 44 (see FIG. 6) between the two switching positions, wherein an intermediate position between the two switching positions is shown in FIG. 6. In a first switching position, the valve element 44 closes a first valve seat 46 which is in connection with the inlet 34. In this switching position, the flow path from the return connection 20 through the second inlet 30 to the circulation pump assembly 28 is therefore open. In a second switching position, the valve element 44 closes a second valve seat 48 which is in connection with the return connection 20. In this switching condition, the flow path through the return connection 20 to the circulation pump assembly 28 is therefore closed and the flow path from the heating water outlet 36 of the secondary heat exchanger 38 to the circulation pump assembly 28 is opened.

At the delivery side of the circulation pump assembly 28, the flow path divides into two flow paths 50 and 52, wherein the first flow path 50 runs through the heat source outlet 12, the primary heat exchanger 4 and the heat source inlet 14 and from there to a first feed connection 16. This means that two sections run from the first flow path 50, in the inside of the hydraulic construction unit 12, specifically the section up to the heat source outlet 12 as well as the second from the heat source inlet 14 to the first feed connection 16. The remainder of the first flow path is formed by the external pipework and the primary heat exchanger 4 which are connected onto the heat source outlet 12 and the heat source inlet 14.

The second flow path 52 which runs at the delivery side of the circulation pump assembly 28, runs in the inside of the hydraulic construction unit 2 to a mixing valve 54. The mixing valve 54 is configured as a 3-way valve and comprises two inlets 56 and 58. The first inlet 56 is in hydraulic connection with the heat source inlet 14, whereas the second inlet 58 is connected via the flow path 52, directly to the delivery side of the circulation pump assembly 28. I.e. heating medium which does not flow through the primary heat exchanger 4 and thus has essentially the same temperature which the heating medium has on entry into the return connection 20, is fed from the delivery side of the circulation pump assembly 28 to the second inlet 58. The mixing valve 54 comprises an outlet 60 which is connected to the second feed connection 18 via a common delivery-side flow path. The temperature which is to say the feed temperature, at which the heating medium exits out of the second feed connection 18 can be adjusted via the mixing valve 54. Heating medium which has not been thermally treated can be admixed via the flow path 52 and via the mixing valve 54, to the heating medium which has been thermally treated by the primary heat exchanger 4 and which is fed from the heat source inlet 14 to the mixing valve 54, in order, in the case of a heating facility, to reduce the feed temperature at the second feed connection 18 with respect to the heating medium temperature at the heat source inlet 18. Since the heating medium is fed directly from the heat source inlet 14 to the first feed connection 16, the feed temperature at the first feed connection 16 is essentially equal to the outlet temperature of the primary heat exchanger 4. Different feed temperatures can therefore be made available at the feed connections 16 and 18.

The mixing valve 54 likewise comprises a drive motor 62 which is configured as a stepper motor. A valve element 64 in the inside of the mixing valve 54 is moved between the valve seats 66 and 68 via the drive motor 62. Thereby, the valve seat 66 is connected to the inlet 58 and the valve seat 68 to the inlet 56. The valve element 64, via the stepper motor 62 can assume different intermediate positions between the two valve seats 66 and 68, so that the free flow cross section from the valve seats 66 and 68 to the outlet 60 is varied. The ratio of the flow cross sections of the inlets 56 and 58 to one another varies, by which means the mixing ratio between the heating media flows flowing through them can be varied. Moreover, a flow path which connects the heat source inlet 14 to a heating water inlet 70 of the first hydraulic side of the secondary heat exchanger 38 is also located in the inside of the hydraulic construction unit 2. If the switch-over valve 30 is located in the respective switching position, the heating medium can flow from the heat source inlet 14 via the heating water inlet 70 through the secondary heat exchanger 38 to the heating water outlet 36 and from there via the switch-over valve 30 into the circulation pump assembly 28. Thereby, the heating medium, via the secondary heat exchanger 38 can heat a service water flow flowing from the service water inlet 22 through the hydraulic second side of the secondary heat exchanger 38 to the service water outlet 24.

Figure 2:
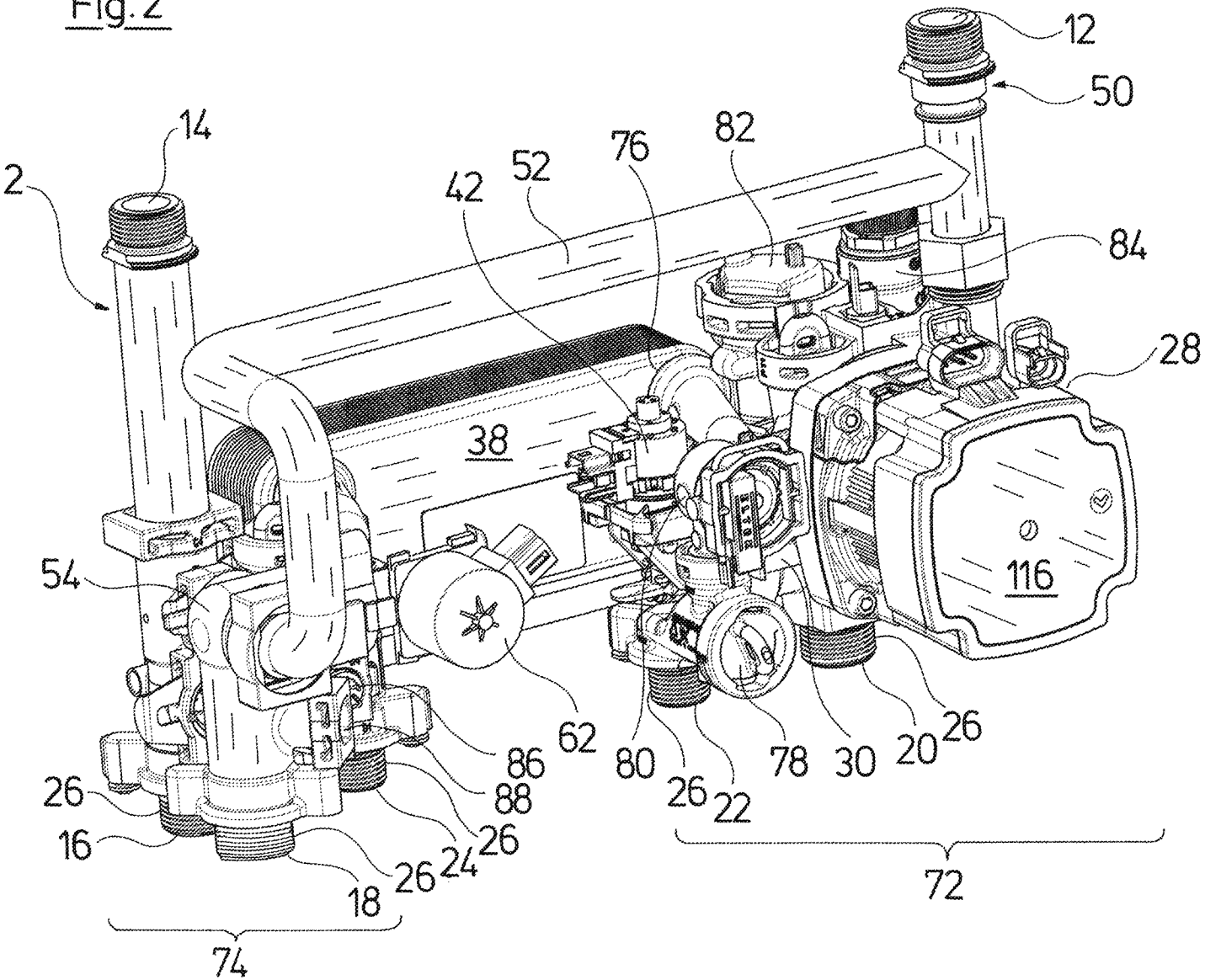
FIG. 2 is a perspective view of the hydraulic construction unit according to the invention.

The components of the hydraulic construction unit 2 which are represented within the dashed line shown in FIG. 1 preferably represent an integrated construction unit which can be integrated into a heating facility as a preassembled construction unit, or however can also be applied in an autarkic manner. The flow paths are preferably integrated into molded parts of plastic which are preferably manufactured by injection molding. FIG. 2 shows a perspective view of such a hydraulic construction unit 2. The hydraulic construction unit 2 consists essentially of two subassemblies 72 and 74 which are connected to one another via a secondary heat exchanger 38 and the second flow path 52 formed as a separate pipe conduit. The subassembly 72 as an essential component comprises the circulation pump assembly 28, onto which the heat source outlet 12 and the second delivery-side flow path 52 branching between the circulation pump assembly 28 and the heat source outlet 12 connects at the delivery side. The first subassembly 72 moreover comprises the return connection 20 as well as the switch-over valve 30. The first inlet 34 of the switch-over valve 30 is connected directly to the heating water outlet of the secondary heat exchanger 38. This flow path as well as the flow path from the return connection 20 to the switch-over valve 30 and the flow path from the second outlet 60 of the switch-over valve 30 to the circulation pump assembly 28 are formed in a plastic molded part which is configured of one part or of several parts. This molded part moreover comprises the flow path from the service water inlet 22 to the inlet connection 76 of the second hydraulic side of the secondary heat exchanger 38. A filter 78 and a flow sensor 80 are arranged in the flow path from the service water inlet 22 to the inlet connection 76. The flow sensor 80 detects whether a flow is present in the flow path or not, and is used to recognize whether heated service water is required or not. If a user opens a water tap, in order to tap warm service water, then this causes a flow in the service water flow path, said flow being recognized by the flow sensor 80 and being transmitted to a control device 82 which can the switch the switch-over valve 30 into that position, in which the heating medium flow runs through the secondary heat exchanger 38. The first subassembly 72 moreover in the usual manner yet comprises further components such as a venting means 82 and a pressure relief valve 84.

The second subassembly 74 comprises the heat source inlet 14, the first feed connection 16, the second feed connection 18 as well as the service water outlet 24. Moreover, in the second subassembly 74, the second delivery-side flow path 52 which is configured as a separate pipe conduit runs out into the mixing valve 54 which is likewise arranged in the second subassembly 24. The flow paths from the described connections in the second subassembly 74 to the mixing valve 54 and to the secondary heat exchanger 38 are likewise configured as plastic molded parts, which can be of one or of several parts. Furthermore, two temperature sensors 86 and 88 are arranged in the second subassembly 74, and these on the one hand detect the temperature in the flow path from the secondary heat exchanger 38 to the service water outlet 24, i.e. the temperature of the heated service water, and on the other hand the temperature in the flow path from the mixing valve 54 to the second feed connection 18, i.e. the second feed temperature. The circulation pump assembly 28 can be regulated in its speed on the basis of the temperature sensor 86 in the service water flow path, in order to set/adjust the supply of heat to the secondary heat exchanger 38 and therefore the service water temperature. The mixing valve can be regulated (closed-loop controlled) via the signal of the temperature sensor 88 at the exit side of the mixing valve 54, in order to adjust the mixing ratio such that a desired feed temperature is achieved.

Figure 5:
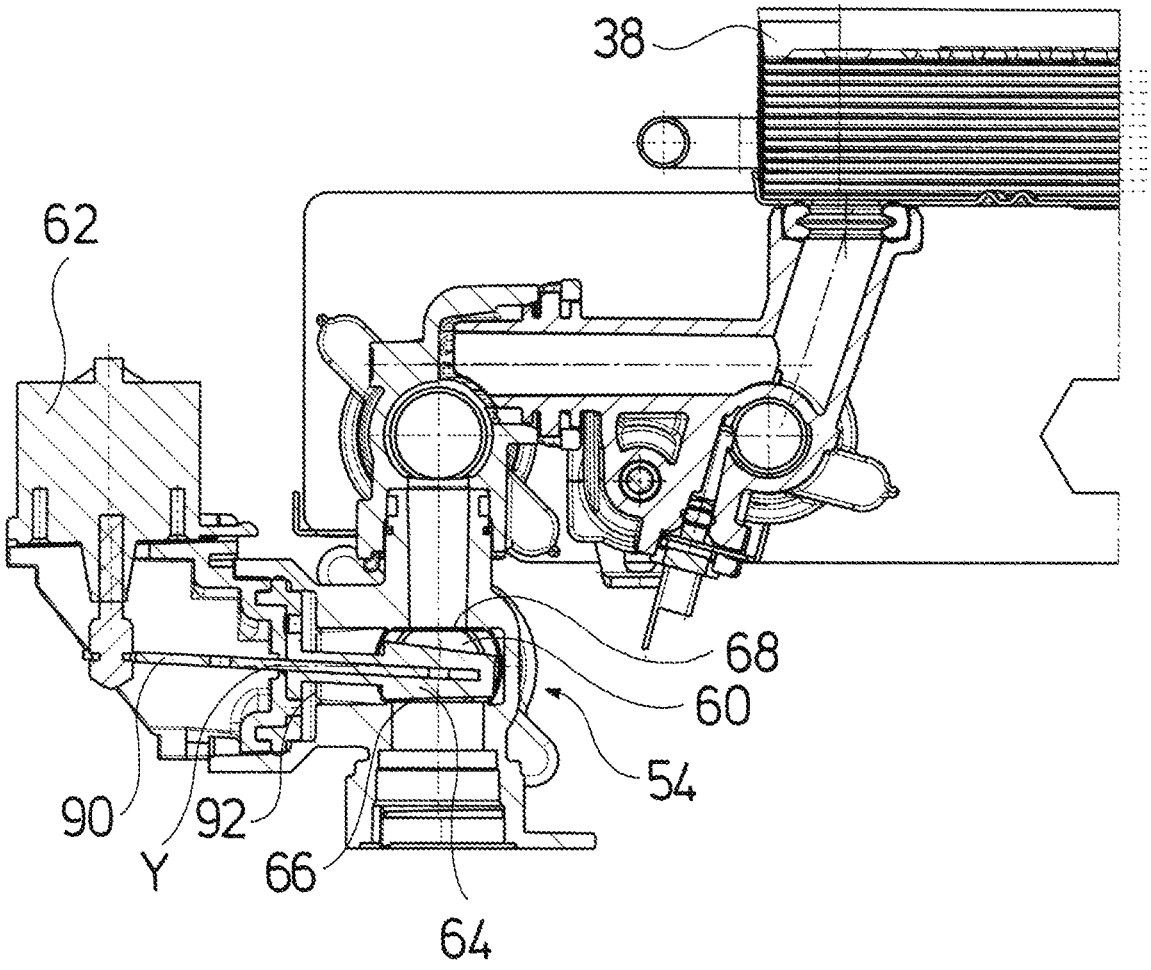
FIG. 5 is a sectioned view of a mixing valve of the hydraulic construction unit.

The mixing valve 54 as well as the switch-over valve 30, as can be recognized in FIGS. 5 and 6, is configured essentially equally. The arrangement of the valve seats 46 and 48 and of the valve element 4 thus corresponds essentially to the arrangement of the valve seats 66 and 68 and of the valve element 64. The drive motor 42 also corresponds to the drive motor 62. The different functionality of the two valves is merely achieved by way of a different activation of the drive motors 42 and 62. Whereas with regard to the switch-over valve 30, the valve element 44 is merely moved between two switching positions, the drive motor 62 in the case of the mixing valve 54 is activated such that one can also move to intermediate positions between the two end positions defined by the bearing contact of the valve element 64 on the valve seats 66 and 68. The valve elements 44 and 64 are connected in each case via an actuating lever 90 to the drive motor 42 and 62 respectively, said motors creating the linear movement. The actuating lever 90 is led through a sealing sleeve 92 and executes a pivoting movement about a pivot axis Y in the region of a housing wall of the valve housing. The essentially equal design of the switch-over valve 30 and of the mixing valve 54 has the advantage of equal components and moreover has advantages with regard to control technology, since it is merely one stepper motor driver which is necessary, in order to activate the drive motors 42 and 62. The drive motors 42 and 62 never need to be actuated simultaneously, so that a single motor driver is sufficient for both.

Figure 3:
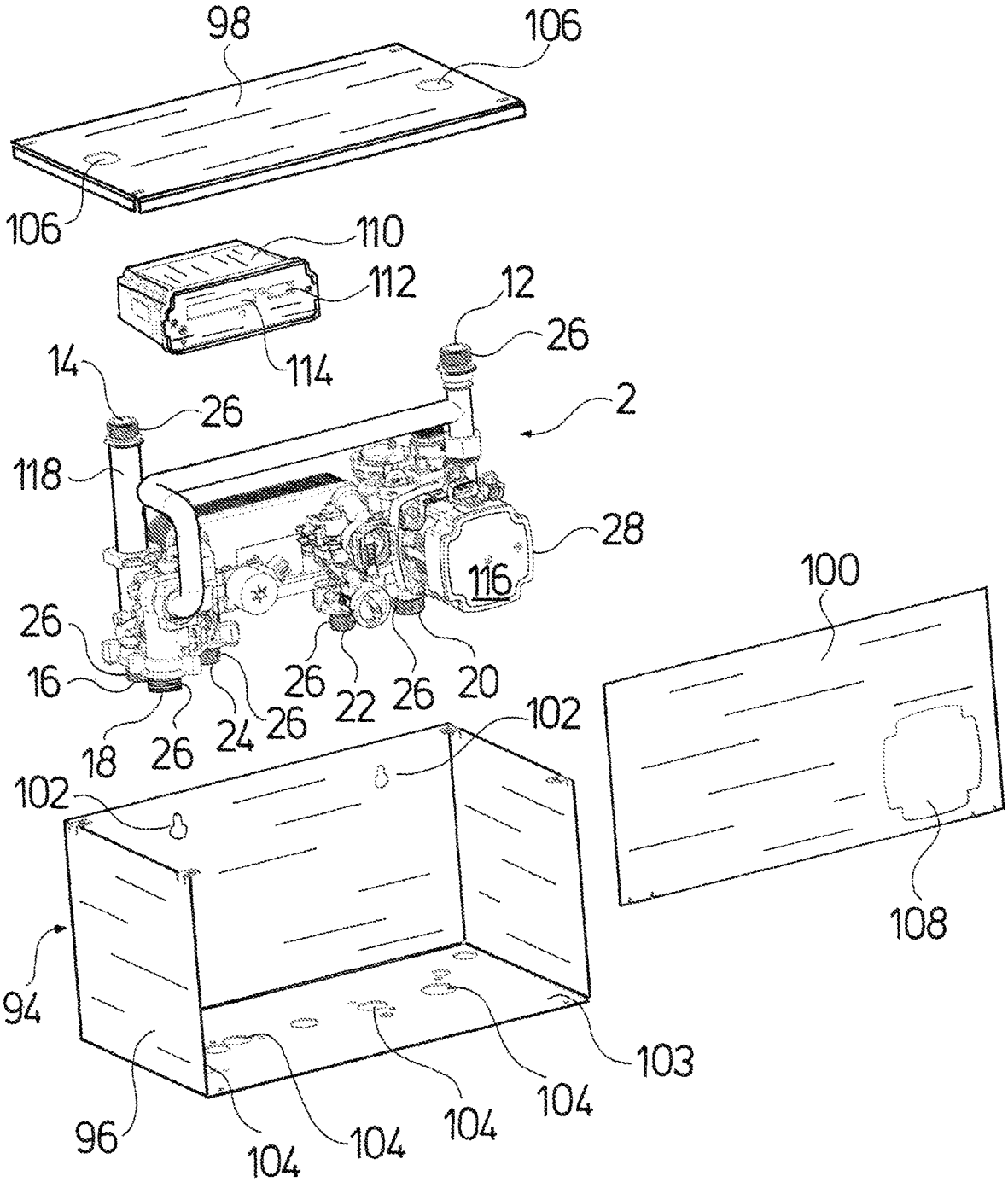
FIG. 3 is a perspective exploded view of a hydraulic construction unit according to the invention, for autarkic application.
Figure 4:
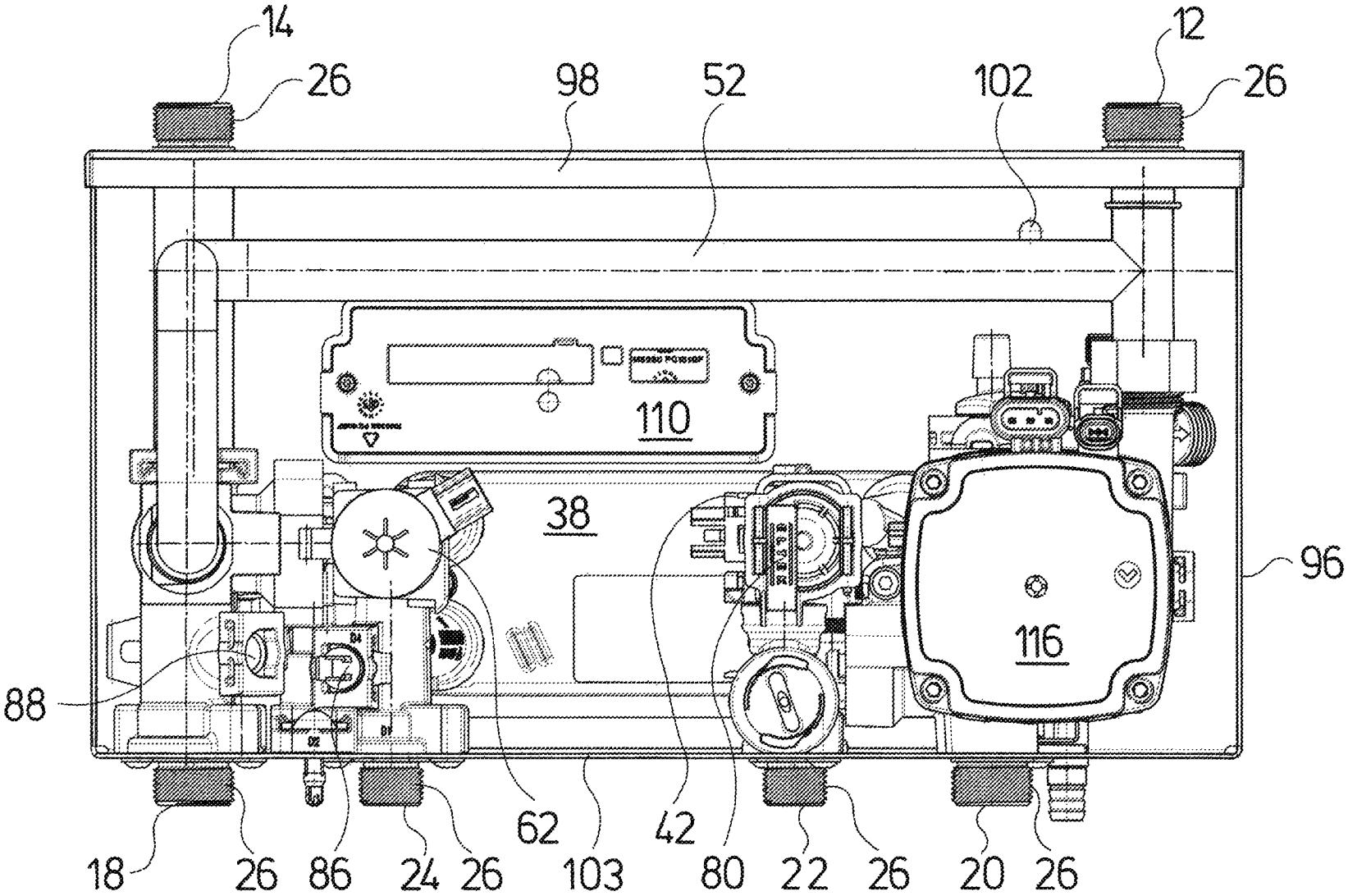
FIG. 4 is a plan view onto the hydraulic construction unit according to FIG. 3, in the assembled condition.
Figure 7:
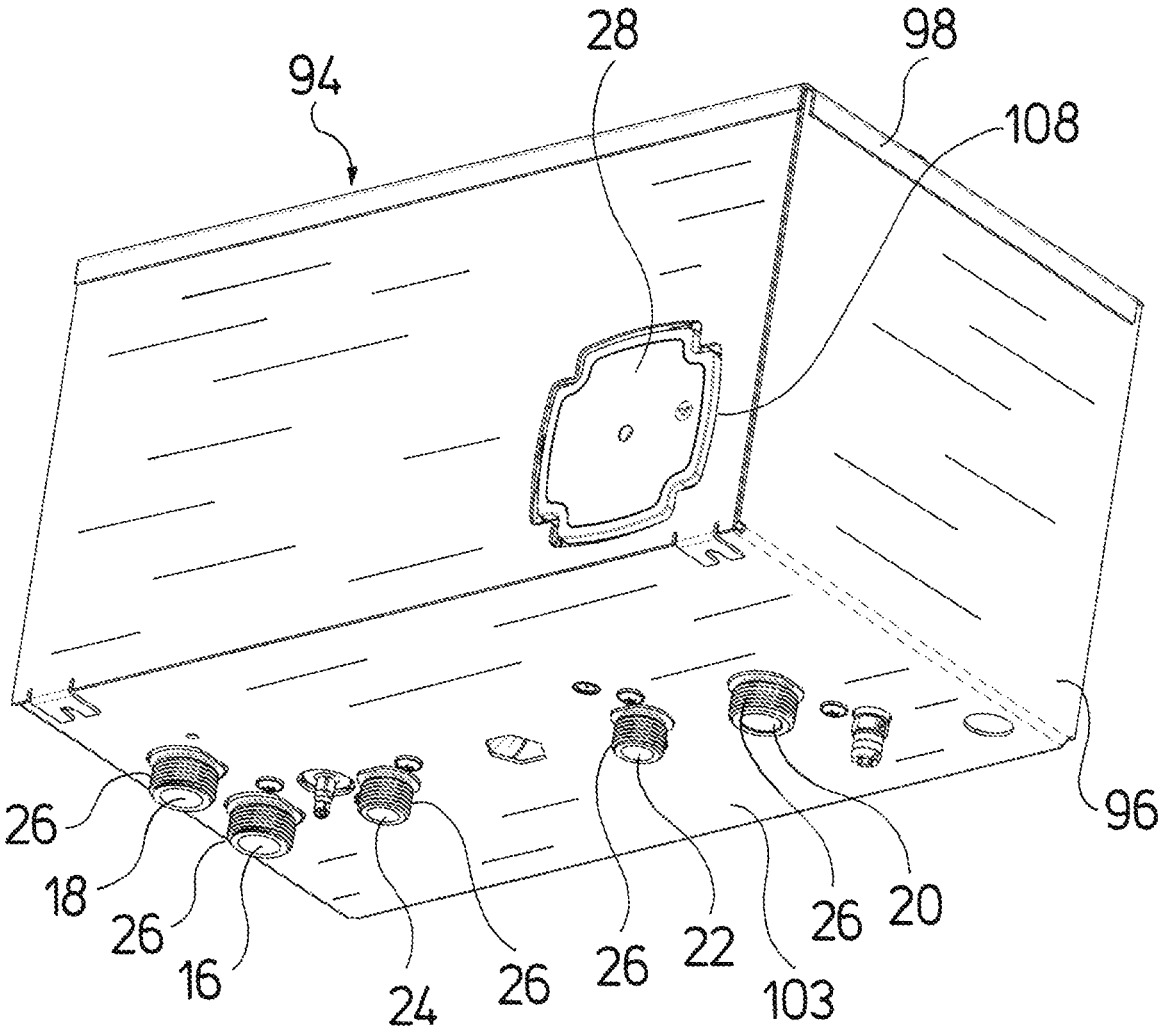
FIG. 7 is a plan view from below, onto the hydraulic construction unit according to FIG. 4.

The described hydraulic construction unit 2 can either be integrated into a heating facility such as a compact heating facility or into a heating boiler or however can be applied in an autarkic manner as described by way of FIGS. 3, 4 and 7. For this, the hydraulic construction unit 2 which corresponds to the hydraulic construction unit 2 shown in FIG. 2 is arranged in a housing 94. The housing 94 simultaneously forms a mechanical supporting element. The housing 94 consists of a housing lower part 96, a housing upper part 8 and of a front plate 100. The housing 94 is preferably formed from sheet metal. The housing lower part 96 at its rear side comprises fastening elements in the form of holes 102. Screws for example, with which the housing lower part 96 can be fastened on a wall, can be led through the holes 102. Moreover, through-holes 104 are formed in the housing lower part 96, on a horizontally extending base plate 103. The first and the second feed connection 16, 18, the return connection 20, the service water inlet 22 and the service water outlet 24 with their connection elements 26 extend through the through-holes 104, wherein the connection elements 26 can be directly mechanically fixed to the base plate 103 in the periphery of the through-holes 104. Forces acting upon the connection elements 26 via the external pipe conduits are thus transmitted directly onto the base plate 103 and thus via the housing lower part 96 onto the fastening elements 102, without loading the plastic molded parts defining the hydraulic flow paths, with excessive forces.

Accordingly, two through-holes 106, into which connection elements 26 of the heat source outlet 12 and of the heat source inlet 14 engage and accordingly can be mechanically fixed to the housing upper part 98 in a direct manner are formed in the housing upper part 98. Thus forces which act upon the connection elements 26 of the heat source outlet 12 and heat source inlet 14 are likewise transmitted directly onto the fastening elements 102 via the housing upper part 58 and the housing lower part 98 connected to this upper part, without loading the structures in the inside of the hydraulic construction unit 2 with excessive forces.

At the front side, the housing 24 is closed by a front plate 100 comprising an opening 108, through which the axial face end of the circulation pump assembly 28 can extend outwards which is to say remains visible from the outside. This has the advantage that operating elements of the circulation pump assembly 28 remain accessible from the outside. A control device 110 assuming control functions which would normally be assumed by the heating control in the case of the integration of the hydraulic construction unit 2 in a heating facility, is arranged in the inside of the housing 94. The control device 10 comprises a first connection region 112, to which the mains connection lead is connected. The control device 110 moreover comprises a second connection region 114, to which the drive motors 42 and 62 are connected via connection leads which are not shown here. Moreover, this second connection region 114 is connected via further connection leads which are not shown, to temperature sensors 86, 88 as well as the flow sensor 80. The control device 10 thus on the one hand assumes the control of the mixing valve 54 and on the other hand the control of the switch-over valve 30. A stepper motor driver is arranged in the control device 110 for this, and this driver activates the drive motors 42 and 62, wherein a single stepper motor driver is sufficient, as has been described above. However, as an alternative, two stepper motor drivers can also be provided. If the control device 110 detects a service water demand by way of the flow sensor 80, it then activates the drive motor 42 so that the flow path through the heating circuits is closed and the flow path for the heating medium through the secondary heat exchanger 38 is opened. In heating operation, i.e. when the switch-over valve 30 is located in the other switching position, the control device 110 activates the drive motor 62, so as to adjust the mixing ratio in the mixing valve 54 such that a predefined exit temperature is achieved at the temperature sensor 88.

It is to be understood that the control device 110 could also be integrated completely into the electronics housing 116 of the circulation pump assembly or however could also be arranged outside the housing 94. The autarkic functionality of the hydraulic construction unit 2 can also be applied in an apartment station, wherein the heat source outlet 12 and the heat source inlet 14 are then connected to the radiant heating system of a building. The pipe piece 118 which is in connection with the heat source inlet 14 can then be replaced by a thermal quantity measuring appliance.

While specific embodiments of the invention have been shown and described in detail to illustrate the application of the principles of the invention, it will be understood that the invention may be embodied otherwise without departing from such principles.

The invention claimed is:

1. A hydraulic construction unit for a heating facility or air-conditioning facility, the hydraulic construction unit comprising:

at least one heating circuit return connection a first heating circuit feed connection for a heating circuit;

a heat source outlet fluid conducting connected to the return connection;

a circulation pump assembly;

a heat source inlet which is fluid conducting connected to the first feed connection as well as fluid conducting connected with the circulation pump assembly which is arranged in a flow path between the return connection and the heat source outlet or in a flow path between the heat source inlet and the first heating circuit feed connection;

at least one second heating circuit feed connection for a second heating circuit, wherein the second heating circuit feed connection is fluid conducting connected to the heat source inlet and to the return connection so that a mixture of fluid from the heat source inlet and the return connection can be fed to the second feed connection; and at least one mixing valve arranged in a first flow path from the heat source inlet to the second heating circuit feed connection and/or in a second flow path from the return connection to the second heating circuit feed connection, the mixing valve being configured to selectively change a mixing ratio between fluid flows in the first and second flow paths to change the temperature at the second feed connection.

2. A hydraulic construction unit according to claim 1, further comprising, downstream of the circulation pump assembly, at least a section of a first delivery-side flow path and at least a section of a second delivery-side flow path, said section of said first delivery-side flow path and said section of a second delivery-side flow path running out into a common flow path, wherein the mixing valve is arranged in at least one of the sections of the first and/or of the second delivery-side flow path, and a cross-sectional ratio between the first delivery-side flow path and the second delivery-side flow path can be changed via the mixing valve.

3. A hydraulic construction unit according to claim 2, wherein the mixing valve is arranged in only one of the first delivery-side flow path and of the second delivery side flow path, for changing the cross section of this delivery-side flow path.

4. A hydraulic construction unit according to claim 2, wherein the mixing valve is arranged in the first delivery-side flow path and in the second delivery-side flow path, such that the cross sections of the first delivery-side flow path and of the second delivery-side flow path can be simultaneously changed via the mixing valve.

5. A hydraulic construction unit according to claim 2, wherein the mixing valve is configured as a three-way mixing valve.

6. A hydraulic construction unit according to claim 2, wherein:

a first inlet of the mixing valve is connected to the heat source inlet;

a second inlet of the mixing valve is connected to the delivery side of the circulation pump assembly upstream of the heat source outlet; and an outlet of the mixing valve is connected to the second heating circuit feed connection.

7. A hydraulic construction unit according to claim 2, wherein the mixing valve is integrated into a pump housing of the circulation pump assembly.

8. A hydraulic construction unit according to claim 2, wherein the mixing valve comprises a movable valve element and an electrical drive motor which moves this valve element.

9. A hydraulic construction unit according to claim 8, wherein the movable valve element is arranged in the inside of a valve housing and the drive motor is arranged outside the valve housing, wherein the valve element is pivotable about a pivot axis and is connected to the drive motor via an actuating lever which extends transversely to the pivot axis and which extends through an elastic seal out of the valve housing.

10. A hydraulic construction unit according to claim 2, further comprising a heat exchanger for thermally treating service water, and a switch-over valve configured such that the flow path which is connected to the circulation pump assembly is switchable over between the heat exchanger and at least one heating circuit connection formed on the construction unit, by way of the switch-over valve.

11. A hydraulic construction unit according to claim 10, wherein the switch-over valve comprises a movable valve element and an electric drive motor which moves this valve element.

12. A hydraulic construction unit according to claim 11, wherein:

the mixing valve comprises a movable valve element and an electrical drive motor which moves this valve element;

the valve element of the mixing valve is configured as the valve element of the switch-over valve and/or that the drive motor of the mixing valve is configured as the drive motor of the switch-over valve.

13. A hydraulic construction unit according to claim 12, wherein the drive motor of the mixing valve and the drive motor of the switch-over valve have a common motor driver which selectively activates the drive motor of the mixing valve or the drive motor of the switch-over valve.

14. A hydraulic construction unit according to claim 1, further comprising a pump control device and a common electronics housing wherein the mixing valve comprises a mixer control device which controls the adjustment of the mixing valve for reaching a desired outlet-side fluid temperature and at least partly is arranged with the pump control device of the circulation pump assembly, in a common electronics housing.

15. A hydraulic construction unit according to claim 1, wherein the circulation pump assembly is arranged in a first subassembly of the hydraulic construction unit, and the mixing valve is arranged in a second subassembly of the hydraulic construction unit, wherein the first subassembly comprises the heat source outlet which is connected to the delivery side of the circulation pump assembly, and the second subassembly comprises the heat source inlet which is connected to the mixing valve.

16. A hydraulic construction unit according to claim 15, wherein in the second subassembly, the heat source inlet is connected to the first heating circuit feed connection provided for connection of a first heating circuit, and to a first inlet of the mixing valve.

17. A hydraulic construction unit according to claim 15, further comprising a heat exchanger for thermally treating service water, and in the second subassembly, the heat source inlet is connected to a heating water inlet of the heat exchanger.

18. A hydraulic construction unit according to claim 17, further comprising a switch-over valve which comprises a first and a second inlet as well as an outlet and is configured for switching a flow path between the two inlets is arranged in the first subassembly, wherein the first inlet is connected to a heating water outlet of the secondary heat exchanger and the second inlet is connected to the return connection.

19. A hydraulic construction unit according to claim 2, wherein the construction unit comprises fastening elements which are configured to fasten the construction unit on a wall.

20. A hydraulic construction unit according to claim 2, wherein the return connection, the first heating circuit feed connection, the second heating circuit feed connection, the heat source outlet, the heat source inlet and a service water inlet as well as a service water outlet are provided with hydraulic connection elements for the connection of external pipe conduits.

* * * * *